US006457191B2

(12) United States Patent
Brandebusemeyer et al.

(10) Patent No.: US 6,457,191 B2
(45) Date of Patent: Oct. 1, 2002

(54) DUAL OUTLET FAUCET

(75) Inventors: Heinz Brandebusemeyer, Menden; Harald Körfgen, Hemer, both of (DE)

(73) Assignee: Friedrich Grohe AG & Co. KG, Hemer (DE)

( * ) Notice: Subject to any disclaimer, the term of this patent is extended or adjusted under 35 U.S.C. 154(b) by 0 days.

(21) Appl. No.: 09/839,434

(22) Filed: Apr. 20, 2001

(30) Foreign Application Priority Data

May 17, 2000 (DE) ..... 100 23 723

(51) Int. Cl.[7] ..... E03C 1/04

(52) U.S. Cl. ..... 4/678; 4/676; 4/675; 137/597; 137/625.4

(58) Field of Search ..... 4/675, 676, 677, 4/678, 668, 623; 137/597, 625.4, 801; 235/445

(56) References Cited

U.S. PATENT DOCUMENTS 3,372,710 A * 3/1968 Miller ..... 137/636.3
3,680,592 A * 8/1972 Hayman ..... 137/625.4
4,077,545 A 3/1978 Karls
5,634,220 A * 6/1997 Chiu ..... 4/678
5,983,938 A * 11/1999 Bowers et al. ..... 137/625.17
6,003,170 A * 12/1999 Humpert et al. ..... 4/623
6,219,860 B1 * 4/2001 Chang ..... 4/678

FOREIGN PATENT DOCUMENTS

EP 0 304 529 3/1989

* cited by examiner

*Primary Examiner*—Gregory L. Huson
*Assistant Examiner*—Huyen Le
(74) *Attorney, Agent, or Firm*—Herbert Dubno; Andrew Wilford

(57) ABSTRACT

A faucet has a base formed with a outwardly open cavity and a pair of confronting open outlet ports opening into the cavity. A sleeve fitted over the base at the cavity has an inner surface directed radially inward at the base, and is rotatable on the base. A spout extending radially outward from the sleeve is formed with a pair of passages each radially inward at the sleeve inner surface into the cavity. A connector in the cavity is formed with an outer surface radially confronting the sleeve inner surface, with a pair of axially oppositely directed tubular inlet nipples fitted in the outlet ports, and with respective passages extending from the nipples and opening radially outward at the outer surface level with the passages. Seals between the surfaces couple the connector to the spout fitting for joint rotation therewith and preventing fluid flow between the grooves.

12 Claims, 2 Drawing Sheets

DUAL OUTLET FAUCET

FIELD OF THE INVENTION

The present invention relates to a dual-outlet faucet. More particularly this invention concerns such a faucet which has a pivotal spout provided with two outlets from which separate flows of liquid can issue.

BACKGROUND OF THE INVENTION

It is known, for instance from U.S. Pat. No. 4,077,545 of Karls to make a faucet having a stationary base having an outer surface centered on an axis and formed with an outlet port connected to a respective supply of water. In this case one of the outlets is fed by a mixing valve to which tempered water is supplied and the other is fed by a separate hot-water supply for scalding water. A spout having the two outlets is carried on a sleeve having an inner surface and provided with passages opening at one end at the inner surface and at the other end at the respective outlet. One of the surfaces is formed with an annular groove centered on the axis and open toward to the other surface so the spout can be pivoted about the axis of the base with liquid flowing freely from the base into and out the spout. Both surfaces may even be formed with radially confronting grooves. Such a fitting is used in a kitchen in place of two separate faucets, one supplying the normal tempered water for washing and the other scalding water for cooking.

In this arrangement the two flows are kept apart by dynamic seal rings set in the base and radially outwardly engaging the spout sleeve. These rings are fairly large in diameter and must be quite snug to prevent leakage. Thus they offer considerable resistance to pivoting of the spout, especially when dry.

In another arrangement described in European patent application 0,304,529 of Hecht-Burgos a single-flow spout is connected to a base body by a tubular elbow fitting having an axial arm fitted into an axially central and axially open bore on the base and a radial arm fixed in the spout sleeve. Thus this fitting rotates with the spout so that the dynamic seal is of small diameter and therefore offers little resistance to pivoting of the spout. This arrangement is constructed such that it could not be adapted to a dual-flow system.

OBJECTS OF THE INVENTION

It is therefore an object of the present invention to provide an improved dual-outlet or -flow faucet.

Another object is the provision of such an improved dual-outlet or -flow faucet which overcomes the above-given disadvantages, that is which is of simple construction but which pivots smoothly.

SUMMARY OF THE INVENTION

A faucet has according to the invention a base body centered on an axis and formed with a radially outwardly open cavity and a pair of confronting and axially open outlet ports opening into the cavity. A spout fitting has a sleeve centered on the axis, fitted over the base at the cavity, having an inner surface directed radially inward at the base and rotatable on the base about the axis. A spout extending radially outward from the sleeve is formed with a pair of passages each having an inner end opening radially inward at the sleeve inner surface into the cavity and an outer end. The inner ends are axially offset from each other. A connector in the cavity is formed with an outer surface radially confronting the sleeve inner surface, with a pair of axially oppositely directed tubular inlet nipples fitted in the outlet ports, and with respective passages extending from the nipples and opening radially outward at the outer surface level with the passage inner ends. One of the surfaces is formed with a pair of axially offset grooves opening toward the other surface and connecting the respective inner ends with the respective passages. Seals between the surfaces couple the connector to the spout fitting for joint rotation therewith and preventing fluid flow between the grooves.

Thus with this system the only dynamic sealing, that is sealing between parts that normally move relative to each other, is needed at the nipples which can be of small diameter so that small O-rings working with little friction can be used. The sealing between the outer surface of the base and the inner surface of the sleeve can be by means of rugged static seals or gaskets that can be guaranteed to prevent cross flow between the passages while in now way impeding free pivoting of the sleeve. Since circumference increases as a multiple of diameter and circumference determines how much surface is in contact in such seal rings, markedly reducing the diameter of the parts having the dynamic sealing has a corresponding great effect in reducing friction. In fact with the smaller seals according to the invention it is possible to use elevated radial sealing pressures without making the spout movement sticky or sluggish.

According to the invention the connector is unitarily formed of one piece with the nipples, normally of molded plastic.

The outer passage ends open on the spout offset from each other. Thus the two flows are kept completely separate, normally radially of the pivot axis.

According to the invention a mixing valve fixed to the base has an output connected to one of the outlet ports. This mixing valve is provided with a single control lever for varying flow to the one outlet port. Separate and distinct supplies of pressurized water are connected to the outlet ports. A flow-control valve fixed to the base is connected between one of the supplies and the other of the ports. This flow-control valve is provided with a control knob mounted on the base part.

In accordance with the invention a brake ring bears radially inward on the base part and radially outward on the s sleeve. The brake ring is hard and the base part is formed with a radially outwardly open groove holding the brake ring. An elastically compressible biasing ring in the groove is braced axially between the base part and the brake ring and urges same radially outward.

The connector according to the invention is formed as a thin-walled sleeve coaxially surrounding the base and formed with an inner part forming the passages and nipples and of a predetermined relatively small angular dimension. The cavity is of a relatively large angular dimension such that the inner part can move angularly in the cavity. Thus the extent of angular travel of the spout fitting on the base is equal to the difference between the angular dimensions of the cavity and inner connector part.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
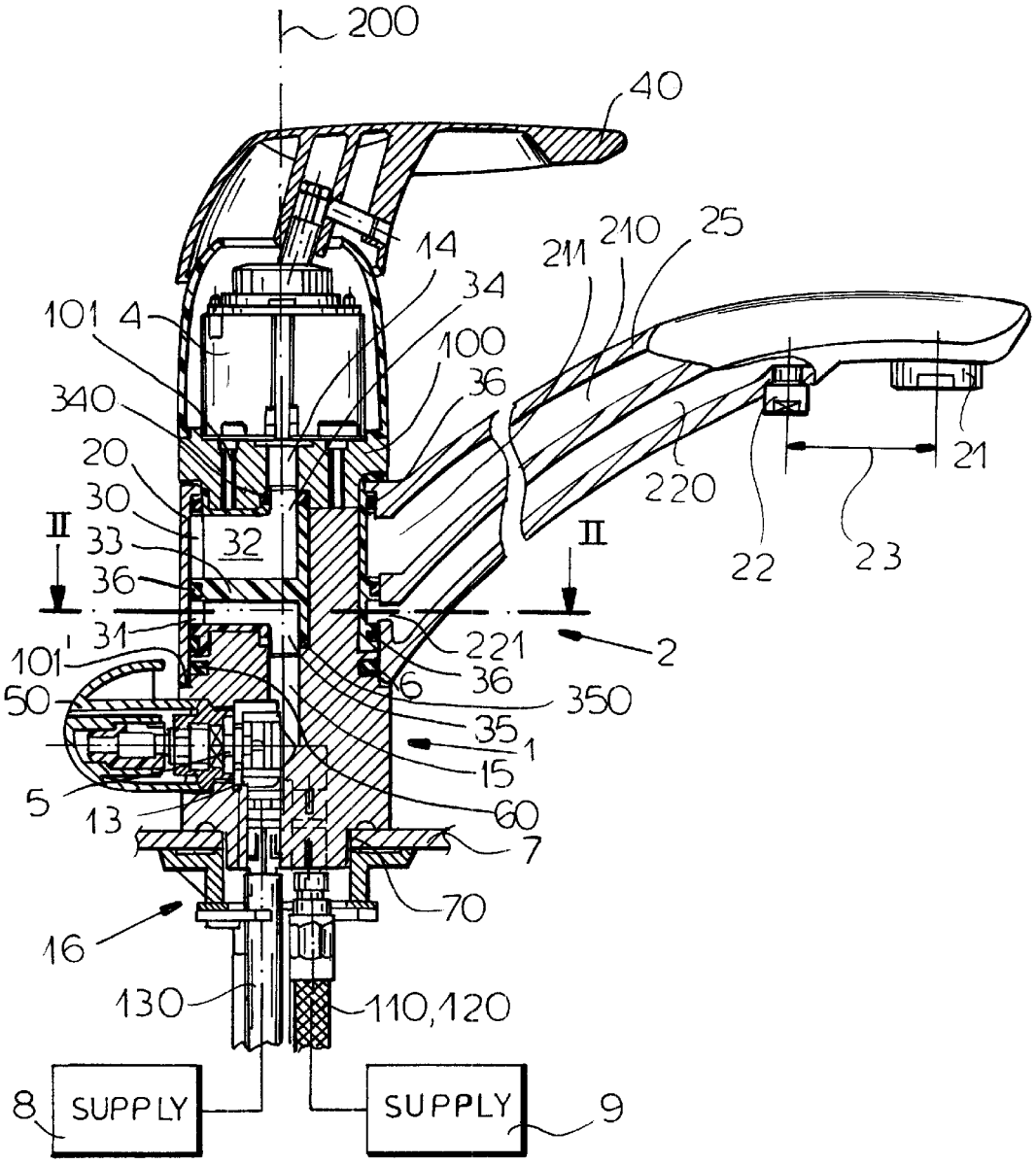
FIG. 1 is an axial section through the faucet according to the invention.
Figure 2:
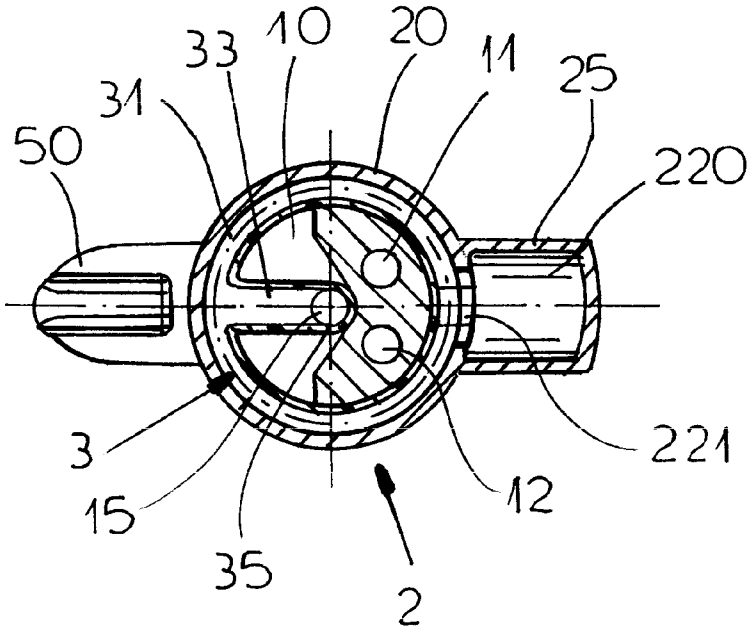
FIG. 2 is a section taken along line II—II of FIG. 1.

As seen in FIGS. 1 and 2 a faucet according to the invention has a base body 1 on which a spout fitting 2 can pivot about an axis 200. The base 1 is a machined metal casting secured to a counter 7 by fittings 16 engaging through a hole 70 in the counter 7. Also extending through this hole 70 are hot-and cold-water feed lines 110 and 120 (the latter behind the former in FIG. 1) connected to respective unillustrated supplies 9 of pressurized cold and hot water and a feed line 130 connected to a supply 8 of pressurized scalding water or other liquids. These lines 110, 120, and 130 are connected to respective axially downwardly open inlet ports 11, 12, and 13 of the base 1. The base 1 also has a top part 100 secured by screws 101 to it.

A standard valve cartridge 4 is bolted to the top part 100 of the base 1 and is provided with a standard lever or handle 40. The two input ports 11 and 12 connected through the base 1 with this valve 4 which has an outlet opening at an axially central port 14 formed in the top part 100 and opening axially downward into a cavity 10 formed therein. As is standard, pivoting of the handle 40 about the axis 200 changes the mix of hot and cold water from the lines 110 and 120 to the outlet port 14, and tipping the handle 40 about an axis perpendicular to the axis 200 changes the volume of flow from the outlet port 14.

The inlet port 13 connects with a simple flow-control valve 5 operated by a knob 50 on the rear of the base 1. When opened, the valve 5 feeds scalding water or other liquids from the supply 8 to an axially central port 15 formed in the base 1 and opening axially upward into the cavity 10 in line with the port 14.

The spout fitting 2 is unitarily formed, normally of metal, of a cylindrical sleeve 20 and a spout 25. The sleeve 20 is captured between a lower face of the top part 100 and an upwardly directed confronting shoulder 101 of the base 1. The spout 25 extends radially upward off the sleeve 20 and is formed with two passages 210 and 220 opening at respective aerator outlets 21 and 22 at the outer end of the spout 25 and via respective ports 211 and 221 radially inward toward the base 1. The two outlets 21 and 22 are spaced apart by a horizontal distance 23, making it easy to establish where the flow is coming from and putting the scalding-water or other liquids outlet 22 back out of the way somewhat.

According to the invention the spout fitting 2 further comprises a molded-plastic connector 3 set in the cavity 10 of the base 1 and formed with a pair of radially outwardly open grooves 30 and 31 respective opening level with the ports 211 and 221. In addition the connector 3 is formed with an axially centered and upwardly axially extending inlet nipple 34 fitting complementarily in the port 14 and sealed relative thereto by an O-ring 340 and with an axially centered and downwardly axially extending inlet nipple 35 fitting complementarily in the port 15 and sealed relative thereto by an O-ring 350. The inlet nipple 34 communicates via a radially extending passage 32 with the upper groove 30 and the inlet nipple 35 via a radially extending passage 33 with the lower groove 31. The inner portion of the connector 3 forming the two parallel passages 32 and 33 and coaxial nipples 34 and 35 is as shown in FIG. 2 of substantially smaller angular dimension than the cavity 10, so that the entire connector 3 can pivot relative to the base 1 through an angular stroke equal to the difference between the angular dimensions of the inner portion of the connector 3 and the cavity 10.

The connector 3 is sealed against the sleeve 20 by three seal rings 36 that flank the grooves 30 and 31 and that act statically, that is they do not normally permit relative movement between the sleeve 20 and fitting 3. The seal rings 340 and 350, however, act dynamically, sealing between the nipples 34 and 35 as they rotate about the axis 200 in the ports 14 and 15. Thus the flows from the valves 4 and 5 totally segregated and the only dynamic sealing action is at the small-diameter rings 340 and 350, so that rotation of the fitting 2 about the axis 200 on the base part 1 is extremely easy. Furthermore since the seals 340 and 350 are normally wet, sealing action does not change as the faucet is used.

Figure 3:
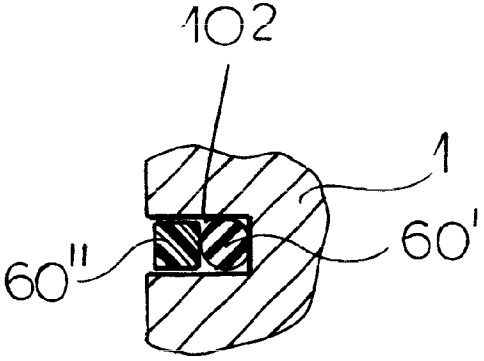
FIG. 3 is a large-scale view of a detail of FIG. 1.

According to the invention a brake 6 is provided to prevent the spout 25 from pivoting too freely on the base 100. This brake 6 comprises as shown in FIG. 3 an elastically compressible ring 60' seated in the base of a radially outwardly open groove 102 cut in the base 1 and a harder plastic brake ring 60" pressed by the biasing ring 60' against an inner face of the sleeve 20. The brake 6 is located outside the wet area defined between the static seal rings 36 so that it stays dry. Thus its braking effect will be the same whether the faucet is being used or not.

What is claimed is:

1. A faucet comprising:

a base centered on an axis and formed with
- a radially outwardly open cavity, and
- a pair of confronting and axially open outlet ports opening into the cavity a spout fitting having
- a sleeve centered on the axis, fitted over the base at the cavity, having an inner surface directed radially inward at the base, and rotatable on the base about the axis, and
- a spout extending radially outward from the sleeve and formed with a pair of passages each having an inner end opening radially inward at the sleeve inner surface into the cavity and an outer end, the inner ends being axially offset from each other;

a connector in the cavity formed with
- an outer surface radially confronting the sleeve inner surface,
- a pair of axially oppositely directed tubular inlet nipples fitted in the outlet ports, and
- respective passages extending from the nipples and opening radially outward at the outer surface level with the passage inner ends, one of the surfaces being formed with a pair of axially offset grooves opening toward the other surface and connecting the respective inner ends with the respective passages; and seal means between the surfaces for coupling the connector to the spout fitting for joint rotation therewith and for preventing fluid flow between the grooves.

2. The faucet defined in claim 1 wherein the connector is unitarily formed of one piece with the nipples.

3. The faucet defined in claim 2 wherein the connector is of plastic.

4. The faucet defined in claim 1 wherein the outer passage ends open on the spout offset from each other.

5. The faucet defined in claim 1, further comprising a mixing valve fixed to the base and having an output connected to one of the outlet ports.

6. The faucet defined in claim 5 wherein the mixing valve is provided with a single control lever for varying flow to the one outlet port.

7. The faucet defined in claim 5, further comprising separate and distinct supplies of pressurized water connected to the outlet ports.

8. The faucet defined in claim 7, further comprising a flow-control valve fixed to the base and connected between one of the supplies and the other of the ports.

9. The faucet defined in claim 8 wherein the flow-control valve is provided with a control knob mounted on the base part.

10. The faucet defined in claim 1, further comprising a brake ring bearing radially inward on the base part and radially outward on the sleeve.

11. The faucet defined in claim 10 wherein the brake ring is hard and the base part is formed with a radially outwardly open groove holding the brake ring, the faucet further comprising an elastically compressible biasing ring in the groove braced axially between the base part and the brake ring and urging same radially outward.

12. The faucet defined in claim 1 wherein the connector is formed as a thin-walled sleeve coaxially surrounding the base and formed with an inner part forming the passages and nipples and of a predetermined relatively small angular dimension, the cavity being of a relatively large angular dimension such that the inner part can move angularly in the cavity.

* * * * *